United States Patent [19]

Burr

[11] Patent Number: 4,547,693

[45] Date of Patent: Oct. 15, 1985

[54] RE-ENTRANT CATHODE SUPPORT

[75] Inventor: John Burr, Wenham, Mass.

[73] Assignee: M/A Com, Inc., Burlington, Mass.

[21] Appl. No.: 497,757

[22] Filed: May 25, 1983

[51] Int. Cl.[4] ..... A47B 51/00

[52] U.S. Cl. ..... 313/270; 313/157; 313/256; 315/39.51

[58] Field of Search ..... 313/156, 157, 270, 256, 313/287; 315/39.51

[56] References Cited

U.S. PATENT DOCUMENTS

| | | | |
|---|---|---|---|
| 1,751,418 | 3/1930 | Paul | 313/157 X |
| 2,416,298 | 2/1947 | Fisk | 313/157 X |
| 2,473,547 | 6/1949 | Schmidt | 313/256 X |
| 2,630,549 | 3/1953 | Sziklai et al. | 313/157 X |
| 2,833,952 | 5/1958 | Hemphill et al. | 313/270 X |
| 2,984,725 | 10/1976 | Cook et al. | 313/157 X |

*Primary Examiner*—Robert Lindsay
*Attorney, Agent, or Firm*—Wolf, Greenfield & Sacks

[57] ABSTRACT

An electron tube having a cathode and an anode with the anode subtantially surrounding the cathode and providing an electron-interaction space therebetween for providing a magnetic field having a substantial component oriented in the axial direction traversing this interaction space. The cathode structure is of reduced axial direction dimension for permitting the length of the magnetic field component to be minimized. The electron tube includes a substantial tubular cathode and a support means that is axially oriented and that is disposed adjacent to the cathode and is spaced away from the cathode substantially throughout its axial length. This support means is attached at one end to one end of the cathode and at the other end is supported at a vocation in the electron tube.

22 Claims, 7 Drawing Figures

RE-ENTRANT CATHODE SUPPORT

Crossed-field electron tubes having a cathode and an anode one of which surrounds the other providing an electron-interaction space between them and means to provide a magnetic field having a substantial component oriented in the axial direction transversing the interaction space are used, for example, as magnetron oscillators and amplifiers, and backward wave oscillators and amplifiers. In the present state of the cathode art, a tubular support is provided for an electron-emitter material and a coil of heater wire (typically a tungsten alloy) is used to heat the emitter. To limit the amount of electrical energy required to raise the cathode to a proper temperature and hold it at that temperature, the structure supporting the cathode and the current carrying leads must present respective high impedances to the flow of heat away from the emitter. This is usually accomplished by selecting support and current lead materials with low coefficients of thermal conductivity, small cross-sectional area and relatively long lengths extending away from the emitter. These long lengths of the thermal conduction paths have become increasingly unacceptable against the growing need to provide magnetrons and other crossed-field electron tubes in smaller sizes and lighter weights, and with smaller and more efficient magnetic components placed close to the electron-interaction space.

This invention relates to axially reduced-size cathode structures in which support and current-carrying components having thermal conduction paths are folded into the axial space occupied by the emitter, in a re-entrant manner, thereby reducing to a minimum the axial length of the cathode structure. Advantages of crossed-field electron tubes incorporating the invention include simple and efficient magnet structures located very close to the electron interaction space, small size, light weight, low cost and rugged tubes capable of withstanding shock and vibration, among other.

DETAILED DESCRIPTION OF THE DRAWINGS

Figure 1:
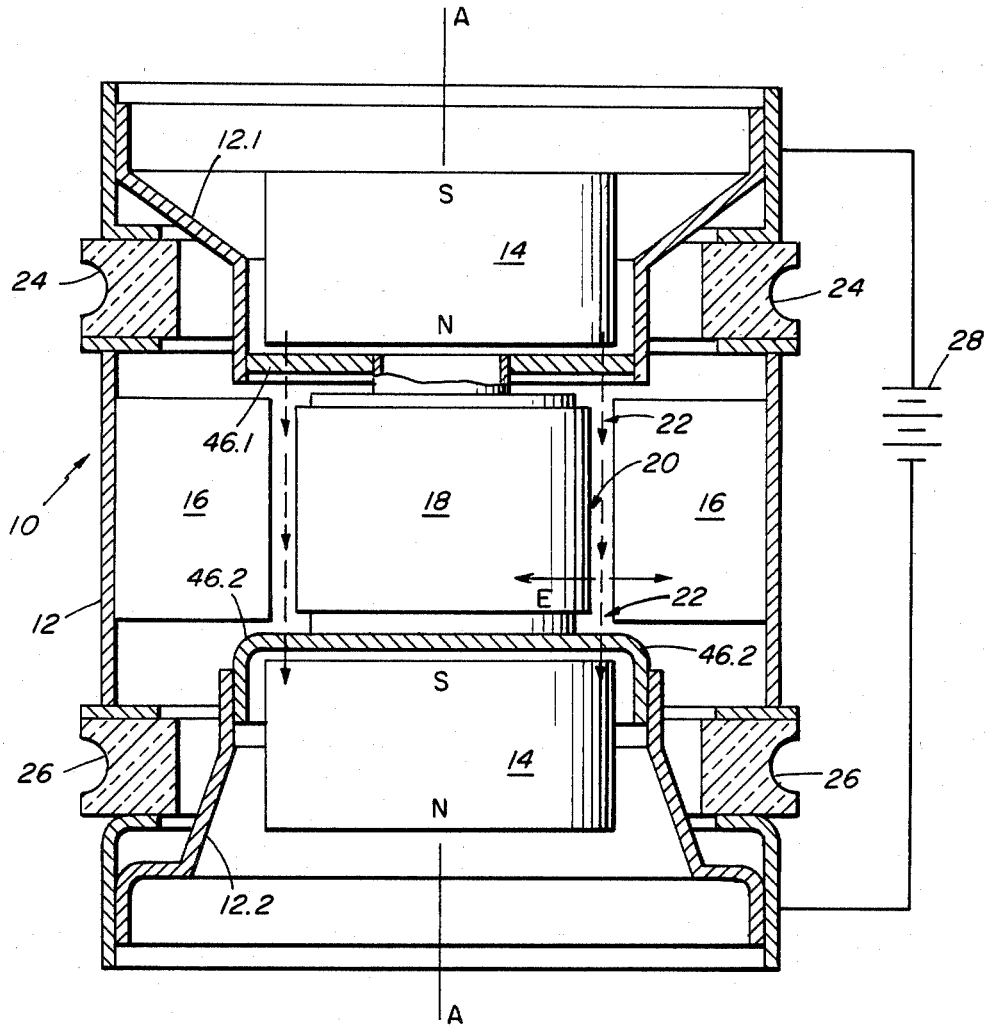
FIG. 1 is an axial section through a magnetron showing a cathode according to the invention in relation to other components of the tube.

In FIG. 1, a magnetron 10 has an envelope 12, two external permanent magnets 14, 14 and an anode 16, all of known design and function. An axially-shortened cathode structure 18 according to the invention is coaxially located within and spaced from the anode, providing an electron interaction space 20 between them. The magnetic field of the permanent magnet has a substantial component 22 oriented in the direction of the axis A—A traversing the interation space, crossing the electric field E existing between the anode and the cathode, as is typical of cross-field electron tubes. Owing to the short length, axially, of the cathode structure 18 confronting the poles N and S of the two magnets can be brought close together and very close to the electron interaction space 20 with a simple magnet structure, thereby providing a strong magnetic field in the interaction space with a small magnet of simple design. There is no need to provide complex pole pieces such as hollow pole pieces, or large, heavy magnets, as heretofore. Savings in size and weight are dramatic.

The end portions 12.1 and 12.2 of the envelope 12 between which the cathode 18 is mounted are electrically isolated, respectively, by rings 24, 26 of dielectric material. Electric heater current for the cathode can then be supplied by connecting, for example, a battery 28 to the end portions 12.1 and 12.2.

Figure 2:
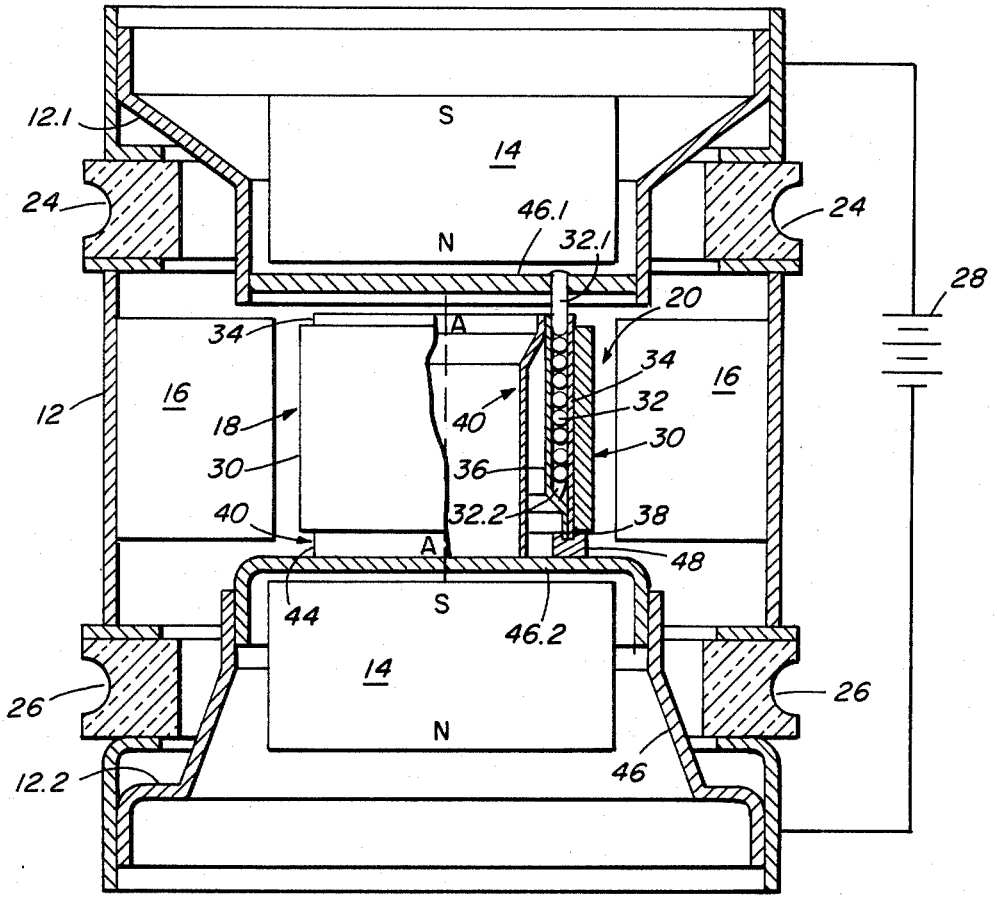
FIG. 2 is a side elevation, partly in section, of an indirectly-heated cathode.

FIG. 2 shows an indirectly-heated cathode structure according to the invention. An electron emitter 30 heated by a helix 32 of tungsten alloy wire, which is connected between end portions 12.1 and 12.2 of the envelope 12, is supported on a tubular mount 34 having the emitter on its outer side and the helix on its inner side. One end 32.1 of the helix 32 is connected directly to a first magnet seat 46.1 and the other end 32.2 is connected indirectly to the second magnet seat 46.2. A second tubular envelope 36 fixed at one axial end 38 to the mount 34 envelops the helix 32, and connects the second end 32.2 of the helix to the second magnet seat 46.2, whereby the entire mount assembly 34, 36 is heated when an appropriate electric current is passed through the helix, as from the battery 28.

A support tube 40 coaxially located within the mount assembly 34, 36 is affixed at a first axial end 42 to the corresponding end of the second inner tubular envelope 36, and at its second axial end 44 to the second magnet seat 46 of the envelope end portion 12.2. The electron emitter 30, and its heater 32, are supported in a thermally-isolated manner from the vacuum envelope 12 and magnet seat 46.2 by the support tube 40, which is coaxially "re-entrant" in the cathode mount assembly 34, 36. The support tube 40 does not add to the axial length of the cathode structure, and it does provide support with a long thermal path to minimize heat loss from the cathode-emitter due to conduction. The resulting low-profile, axially-shortened cathode structure 18 approaches as near as is practical to the shortest possible axial length, and allows for close proximity of the magnet poles N and S to the electron interaction space 20, substantially immediately adjacent the axial ends of the emitter 30, and reduces significantly the size and weight requirements of the magnets 14.

Mechanical stability of the cathode support can be enhanced with a plurality of segmented additional support members 48 (of which only one is shown) between the axial end 38, where the mount 34 is joined to the second tubular envelope 36, and the second magnet seat 46.2. These additional support members 48 are made of a material with very low thermal and electrical conductivity, preferably a ceramic material which is desirable for its property of rigidity. A cathode structure fitted with these additional support members may be used to enhance mechanical stability of the cathode within a magnetron or the like for severe environments.

In FIGS. 3–7 the emitter material 30 fixed to the tubular mount 34 is held at the first and second axial ends 52 and 54 of the mount between first and second inter-digitally arrayed support tubes 56 and 58, respectively, re-entrantly located within the tubular mount 34, which function also as electrical conductors over which heater current may be passed through the tubular mount 34 and the emitter material 30. The first support tube 56, shown in FIGS. 6 and 7, comprises a round base 60, a cup portion 62 and three fingers 63, 64, 65 extending axially from the periphery of the cup portion and symmetrically arrayed around the axis A—A of the cathode structure. The free ends of the fingers 63, 64, 65 are fixed to the first axial end 52 of the tubular mount 34. The end of the first support tube 56 containing the base 60 extends through the tubular mount beyond the second axial end 54 to the first magnet seat 46, to which the base 60 is affixed.

Figure 4:
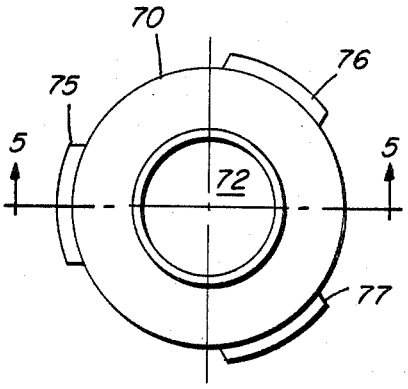
FIG. 4 is an end view of one of the re-entrant cathode supports taken on line 4—4 in FIG. 3.
Figure 5:
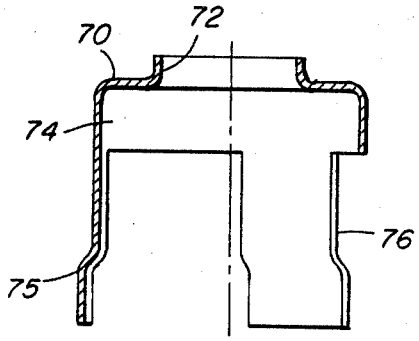
FIG. 5 is a section on line 5—5 of FIG. 4.

The second support tube 58, shown in FIGS. 4 and 5, comprises a round base 70 having a central aperture 72, a cup portion 74 and three fingers 75, 76, 77 are fixed to the second axial end 54 of the tubular mount 34. The end of the second support tube 58 containing the base 70 extends through the tubular mount beyond the first axial end 52 toward the second magnet seat 46. An axially-located stiffener tube 78 passing at its first end 80 through the aperture 72 is fixed to the base 70 and at the end 80 to the second magnet seat 46. The second end 82 of the stiffener tube 78 is fixed to a rigid insulator 84 which in turn is fixed to the inner surface of the base 60 of the first support tube 56.

Figure 3:
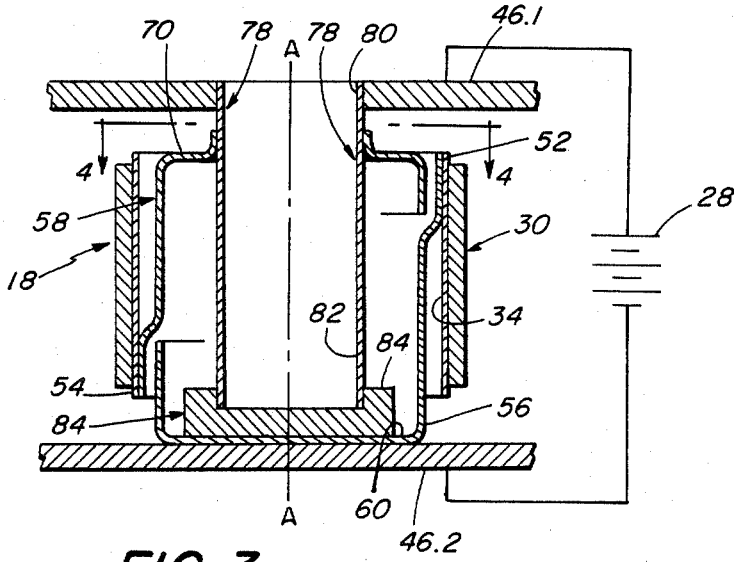
FIG. 3 is an axial section through a directly-heated cathode.
Figure 6:
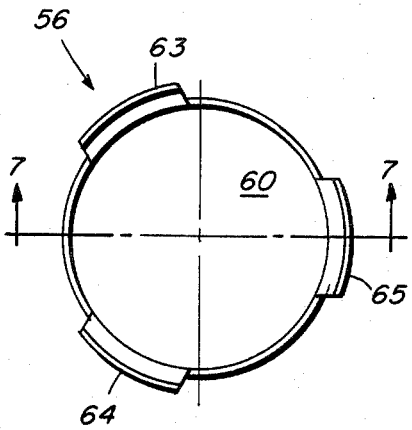
FIG. 6 is an end view of the second of the re-entrant cathode supports in FIG. 3.
Figure 7:
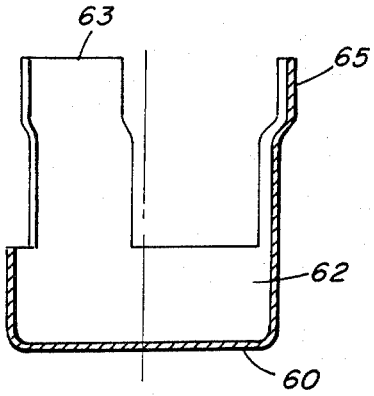
FIG. 7 is a section on line 7—7 of FIG. 6.

The functional properties of the directly-heated cathode as illustrated in FIG. 3 are now apparent. The electron-emitting material 30 is heated by passing an electrical current directly through the material itself. The electrical conduction path, mechanical support and thermal isolation are provided by the two opposite-facing, inter-digitally arrayed segmented support tubes 56, 58 which are respectively mounted on the vacuum envelope magnet seats 46.1 and 46.2. The fingers 63, 64, 65 and 75, 76, 77 are alternately arrayed in a circular locus around the axis A—A, out of contact with the tubular mount 40 except at their ends affixed to the mount, and each spaced away from its neighbors in the circumferential direction around the axis. The number of fingers (segments) on each support tube is optional. This arrangement provides a "heat dam" path, again of the cathode emitter 30, which simultaneously provides the required connections to complete the cathode heater-current circuit while maintaining the required thermal isolation of the emitter. The assembly including the support tubes 56, 58 mounted to the respective magnet seats 46.1 and 46.2 is ruggedized by the stiffener tube is effective to prevent flexing movements of the magnetron envelope 12 and magnet seats 46.1 and 46.2 from being transmitted into the cathode structure 18 and altering the symmetry of the cathode structure. The stiffener tube 78 provides an electrical conduction path for the second support tube 58, and is electrically insulated from but mechanically joined to the first support tube 56 by the insulator 84. The low-profile, short axial-lenth properties and advantages of the FIG. 3 embodiment of the invention are similar to those of the indirectly-heated embodiment of FIG. 2. Desirably, the permanent magnets 14, 14 are electrically isolated one from the other, and no return path is needed between them.

What is claimed is:

1. In an electron tube having a cathode and an anode one of which substantially surrounds the other providing an electron-interaction space between them and means to provide a magnetic field having a substantial component oriented in the axial direction traversing said interaction space, a cathode structure of reduced axial dimension for permitting the length of said magnetic field component to be minimized comprising a substantially tubular cathode and first axially-oriented support means adjacent to and substantially throughout its axial length spaced away from said cathode, means to attach a first axial end of said support means to a first axial end of said cathode, the second end of said support means extending axially beyond the second axial end of said cathode for fixing said cathode to a first location in said electron tube.

2. A cathode structure according to claim 1 including further support means attached to said second axial end of said cathode for additionally fixing said second axial end in said electron tube.

3. A cathode structure according to claim 2 wherein said further support means is made of a material with low thermal and electrical conductivity.

4. A cathode structure according to claim 3 wherein said further support means is made of a ceramic material so as to enhance mechanical stability of said cathode structure in said electron tube.

5. A cathode structure according to claim 2 in which said further support means comprises second axially-oriented support means adjacent to and substantially throughout its axial length spaced away from said cathode and being attached at a first axial end to said second axial end of said cathode, and extending at its second end axially beyond said first axial end of said cathode for fixing said cathode to a second location in said electron tube.

6. A cathode structure according to claim 5 wherein said cathode is the directly-heated type, and said first and second support means are each electrically-conductive, for supplying heater current to said cathode.

7. A cathode structure according to claim 5 in which each of said first and second support means is substantially cup-shaped with a circular-shaped base and finger-like members extending axially from its base to one axial end, respectively, of said cathode, the fingers of one of said support means being interdigitally spaced from the fingers of the other of said support means in a cylindrical locus which is substantially coaxially spaced from said cathode, said bases being the respective second ends of said first and second support means.

8. A cathode structure according to claim 7 wherein said locus is within said cathode.

9. A cathode structure according to claim 7 in an evacuable envelope having first and second parallel spaced-apart magnet seats wherein said bases are mounted one to each of said magnet seats, respectively.

10. A cathode structure according to claim 7 including a substantially rigid electrically non-conducting stiffening member located axially within said structure, said stiffening member being fixed at one end to one of said bases and at its other end to the other of said bases.

11. A cathode structure according to claim 1 wherein said cathode is the indirectly-heated type including an electron-emitter and a tubular mount within said emitter and a heat coil supported by said mount within said cathode, said first axial end of said support means being attached to a first axial end of said mount.

12. A cathode structure according to claim 1 wherein said support means is on a tubular locus within said cathode.

13. A cathode structure according to claim 11 wherein said support means is on a tubular locus within said mount.

14. A cathode structure according to claim 1 in an envelope having first and second magnet seats spaced apart a distance which provides space for said cathode structure, said support means being fixed at said second end to one of said magnet seats.

15. A cathode structure according to claim 14 including further support means attached to said second end of said mount for fixing said cathode relative to said one magnet seat.

16. A cathod structure according to claim 14 including means in said envelope to insulate said magnet seats electrically from each other, and means to supplly electric heater current to said cathode with at least one of said magnet seats.

17. A cathode structure according to claim 1 wherein said first axially-oriented support means comprises a support tube that is substantially concentric to the tubular cathode.

18. A cathode structure according to claim 17 wherein the support tube is disposed inside of the tubular cathode.

19. A cathode structure according to claim 18 wherein the support tube is in parallel to the tubular cathode substantially throughout its axial length.

20. A cathode structure according to claim 1 wherein the support means is disposed inside of the tubular cathode.

21. A cathode structure according to claim 1 wherein said axially-oriented support means has a larger diameter at its top end than the diameter throughout the substantial portion of its axial length.

22. A cathode structure according to claim 1 in which the primary support for the tubular cathode is only provided by the axially-oriented support means.

* * * * *